United States Patent [19]

Gabriel

[11] Patent Number: 4,778,211

[45] Date of Patent: Oct. 18, 1988

[54] SHOVEL-LIKE, DIGGING, SCOOPING AND TRANSPORTING APPARATUS

[76] Inventor: Edwin Z. Gabriel, 91 Mt. Tabor Way, Ocean Grove, N.J. 07756

[21] Appl. No.: 887,738

[22] Filed: Jul. 21, 1986

[51] Int. Cl.[4] ..... E02F 3/02

[52] U.S. Cl. ..... 294/115; 37/185; 294/50.8

[58] Field of Search ..... 37/185; 294/106, 93, 294/111, 50.8, 68.23, 115, 118

[56] References Cited

U.S. PATENT DOCUMENTS

| | | | |
|---|---|---|---|
| 869,657 | 10/1907 | Rogers | 37/185 |
| 2,176,921 | 10/1939 | Neff | 37/185 |
| 2,617,211 | 11/1952 | Olson | 37/185 |
| 4,678,220 | 7/1987 | Gabriel | 294/118 |

FOREIGN PATENT DOCUMENTS

| | | | |
|---|---|---|---|
| 1350017 | 12/1963 | France | 37/185 |

*Primary Examiner*—Clifford D. Crowder

[57] ABSTRACT

This is a multi-purpose apparatus capable of digging, scooping up materials, loading and transporting such to a selected site for unloading with automatic loading and unloading features. It comprises two elongated pieces, curved toward each other at lower portions, and pivoted together near their mid-sections with a pivot pin. The ends of their lower portions have teeth that mesh with each other, when closed. A rod-like member with a knob at its upper end is fixed to the pivot pin. In addition, a shorter tubular slide, with a cylindrical prism at one end and a grooved portion at its bottom end, rides up and down the rod-like member. The tubular slide has provision for either an individual or a robot arm to grasp it and manipulate the apparatus for scratching and digging into the material. This provision also enables one to lift and automatically load the loosened materials. One or more wheels are provided at one of the device's lower portions to enable its user to transport the scooped up material to a selected site. To unload the material, one simply lifts the apparatus by the knob of the rod-like member. The lower portions separate by virtue of the weights located at the top of its upper portions, so that the scooped up material may unload.

10 Claims, 12 Drawing Sheets

Fig. 47
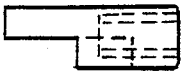
Fig. 46
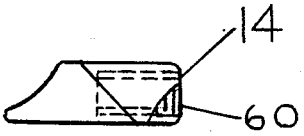
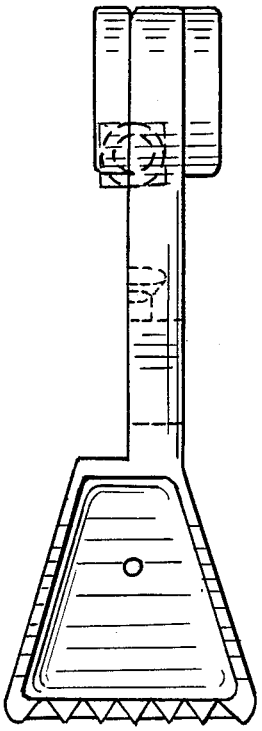
Fig. 41
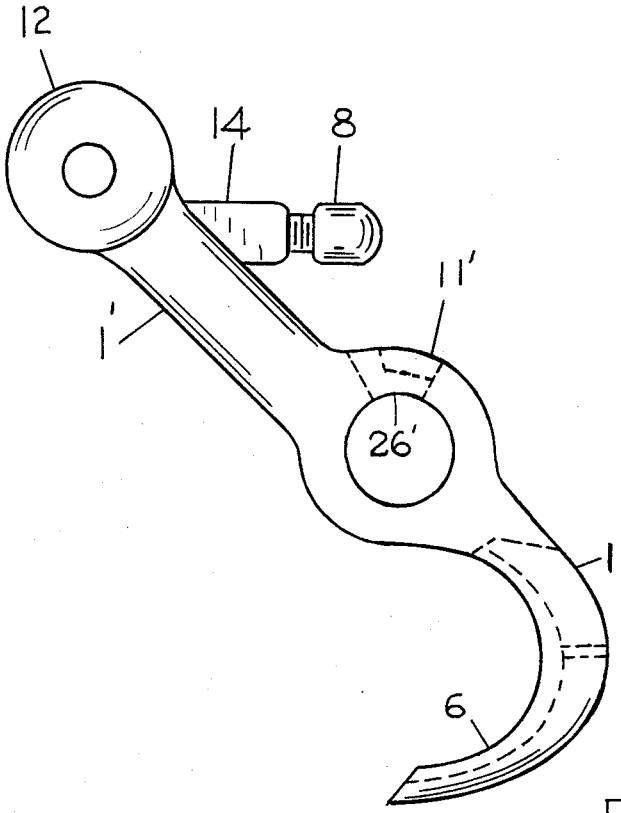
Fig. 40
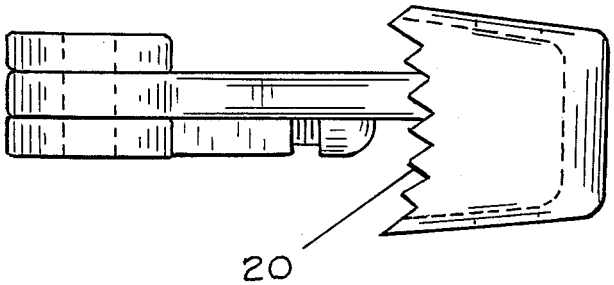
Fig. 42

Fig. 49
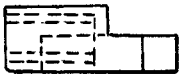
Fig. 48
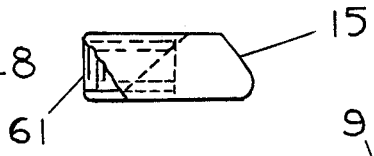
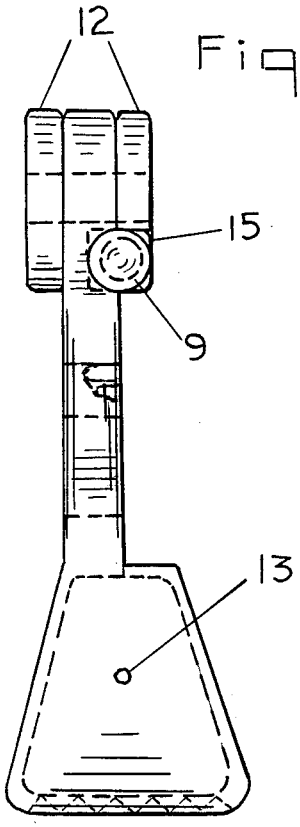
Fig. 44
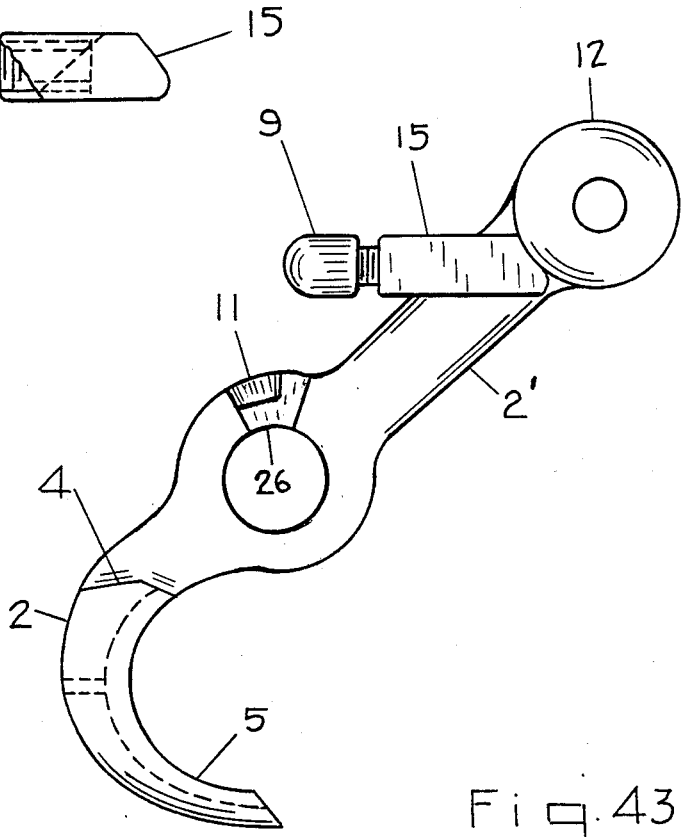
Fig. 43
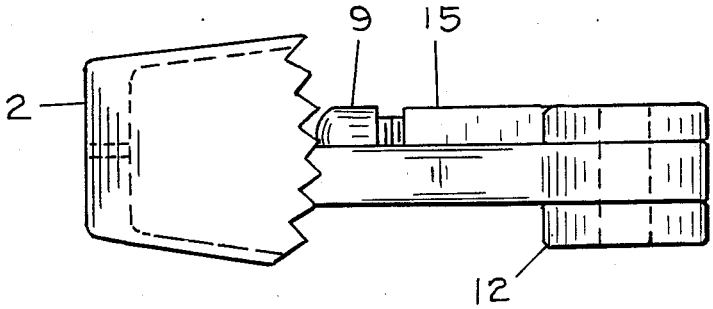
Fig. 45

SHOVEL-LIKE, DIGGING, SCOOPING AND TRANSPORTING APPARATUS

BACKGROUND

In the past several tools have been required to perform a combination of operations. To dig into relatively soft materials, hand tools such as spades, forks, and hoes are used. For lifting such materials from the ground, shovels and scoops of various types are used. To transport the scooped up material, a wheel barrow, a pick-up truck, a dump truck or a wagon is used. To unload the material, again shovels or a dump truck may be used. For removing debris from the bottom of small lakes or from sewer manholes, another tool called a clam shell or handi-clam is used. For catching fish special fishing equipment may be used. For removing water from a flooded basement, buckets may be used. For fighting forest fires, other tools may be used. To remove garbage from streets, manual methods are used. The garbage bags and cans are manually lifted, carried and dumped onto a garbage truck. For dredging small lakes, vacuuming apparatus and other power equipment may be used. For excavating and moving large quantities of dirt or soil, front end loaders and power shovels, costing $50,000 and up, are used. The above apparatus and equipment cannot get into small restricted areas to remove debris or dirt, and they require fuel to operate. The provision of adequate time for maintenance and the availability of spare parts for repairs are always a problem with power equipment, in addition to skilled labor costs.

Using the apparatus described herein, one may replace the operations and functions of the many tools described above with one tool. This one tool may be capable of outperforming any or all of them because of its automatic loading and unloading features.

SUMMARY OF THE INVENTION

This ia a multi-purpose, material handling apparatus which is capable of doing what many other existing garden tools together can do, but may be able to perform their functions more ably. This is not only because of its automatic loading and unloading features, but also because of the time saved in not having to grab different tools for different operations, one at a time. For example, to dig a spade may be used; or hauling material, a wheelbarrow may be used; and to unload material, substantial effort may be required. then to spread the material, if earth soil, a rake may be used. This apparatus is capable of combining all of the above functions into one single tool.

The apparatus comprises two elongated pieces, curved toward each other at their lower ends, and pivoted near their mid-sections with a pivot pin. The ends of their lower portions have teeth that mesh with each other, when in mating contact. A solid rod with a knob at its upper end is fixed to the pivot pin, and the two elongated pieces rotate about this pin. A shorter, tubular rod with a steel cylinder at one end rides up and down the solid rod, the solid rod passing through its hollow interior. Provision for the user to grasp and hold on to the tubular rod exists in the form of a plastic sleeve, for the user to scoop up and automatically load material. The loaded material may then be transported on the wheels attached to the underside of one of the device's lower portions to a selected site for unloading. Either the knob or the tubular rod may be grasped by the user for the transportation phase. At the dump location, the tubular rod is pushed down so that its bottom end makes contact with the hub surrounding the pivot pin. During the process of this operation, the device's lower portions automatically separate from each other, allowing the enclosed material to discharge. This automatic separation is cuased by the resulting torques of the upper portions, produced by gravity, exceeding the torques produced by the lower portions.

For digging into soft material, after having discharged all materials scooped up, the tubular rod is pushed down against the hub allowing the teeth at its lower portions' ends to penetrate the material; then the device could be moved back and forth and sideways to loosen up sufficient material to be loaded. As soon as the device is lifted with the tubular rod, its lower portions automatically come together and engage. This operation occurs automatically because a continuous cable, attached to and passing through a hole in each of the device's upper portions, straddles the tubular rod's grooved enlarged portion and is retained within its circumferential groove with the aid of binding wires. Thus, when the tubular rod moves up and down, the cable supported by the rod moves up and down with the rod, causing the lower portions to come together when the rod is moved upward. When the same rod is moved down, the lower portions automatically separate, unloading the material.

For lifting wet materials and removing any excess liquids in the process, the bottoms of the lower portions are perforated, for allowing the liquids to strain off. Then, to enable the device to hold water, the lower portions are bucket-shaped, and the ends of the lower portions need not have teeth. However, the ends are provided with resilient plastic or rubbery material to seal the line of contact between the two contacting ends, making the bucketshaped portions water tight. Of course, the perforations would not exist for this version. (A previous patent application by the inventor shows the bucket-shaped lower portions without teeth.) For heavy work, a robot arm may be used to hold the apparatus and manipulate the sliding tubular member.

BRIEF DESCRIPTION OF DRAWINGS

For the purpose of illustrating the invention, there are shown in the drawings forms thereof which are presently preferred. It is understood, however, that this invention is not necessarily limited to the preceise arrangement, instrumentalities and field of utility as therein demonstrated.

FIG. 40 is a detail of one of the two elongated pivoted pieces comprising the structural apparatus shown in FIG. 1.

FIG. 41 is a side view thereof.

FIG. 42 is a bottom view thereof.

FIG. 43 is a detail of the other half of the two elongated pivoted pieces comprising the structural apparatus shown in FIG. 1.

FIG. 44 is a side view thereof.

FIG. 45 is a bottom view thereof.

FIG. 46 is a front detail view of the horizontal projection attached to upper portion of apparatus, FIG. 40.

FIG. 47 is a top view thereof.

FIG. 48 is a front detail view of the horizontal projectin attached to upper portion of apparatus, FIG. 43.

FIG. 49 is a top view thereof.

DESCRIPTION OF PREFERRED EMBODIMENT

Figure 1:
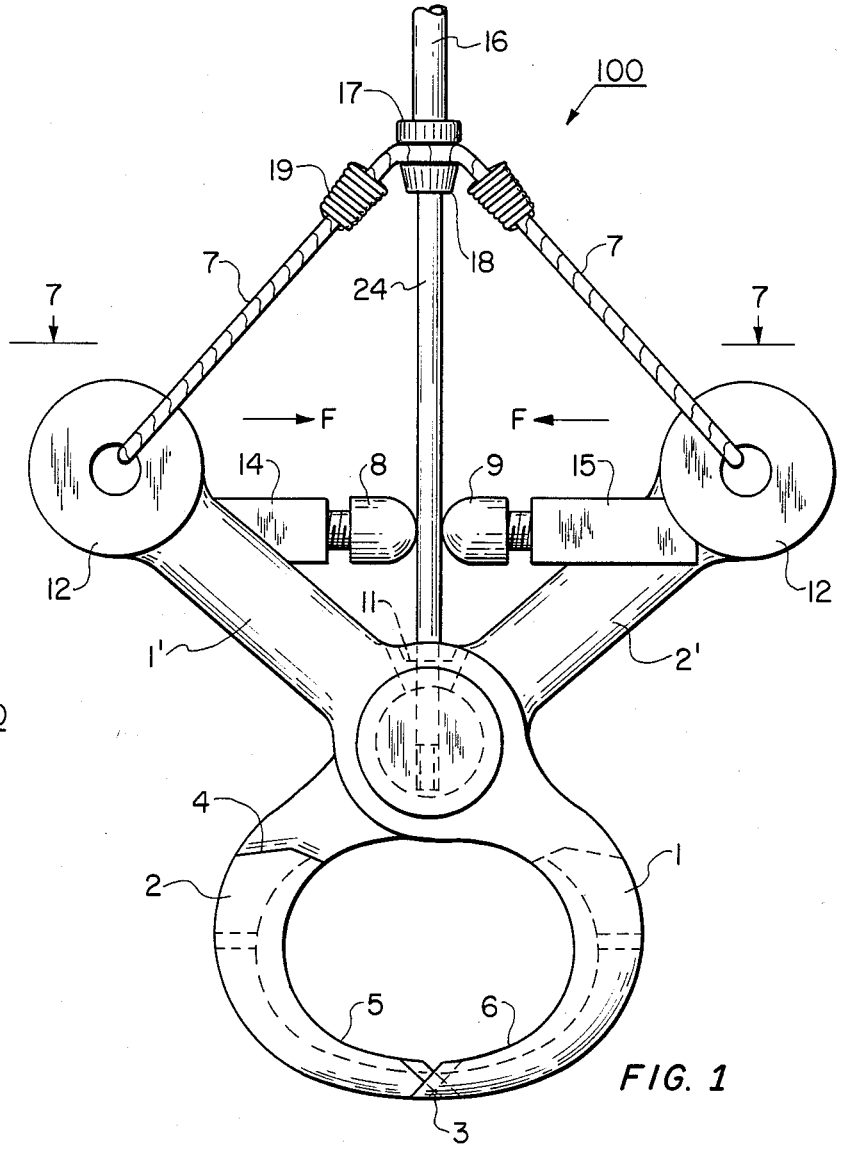
FIG. 1 shows a front assembly view of the shovel-like, materialdigging, scooping and unloading device in its suspended position, with its lower portions in mating contact.
Figure 2:
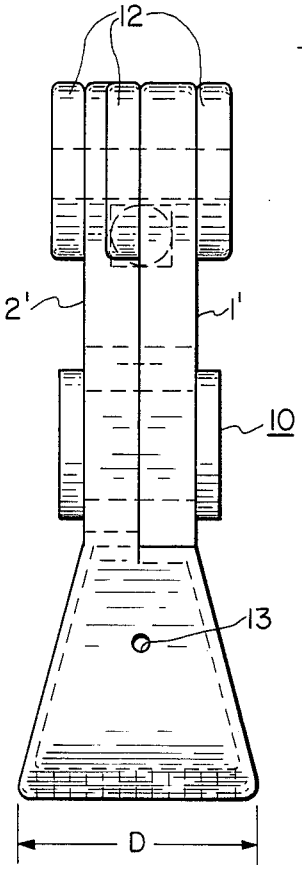
FIG. 2 is a side view thereof.
Figure 3:
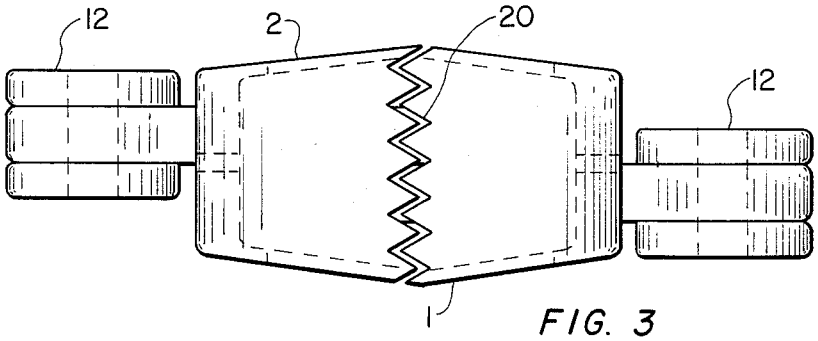
FIG. 3 is a bottom view thereof.
Figure 4:
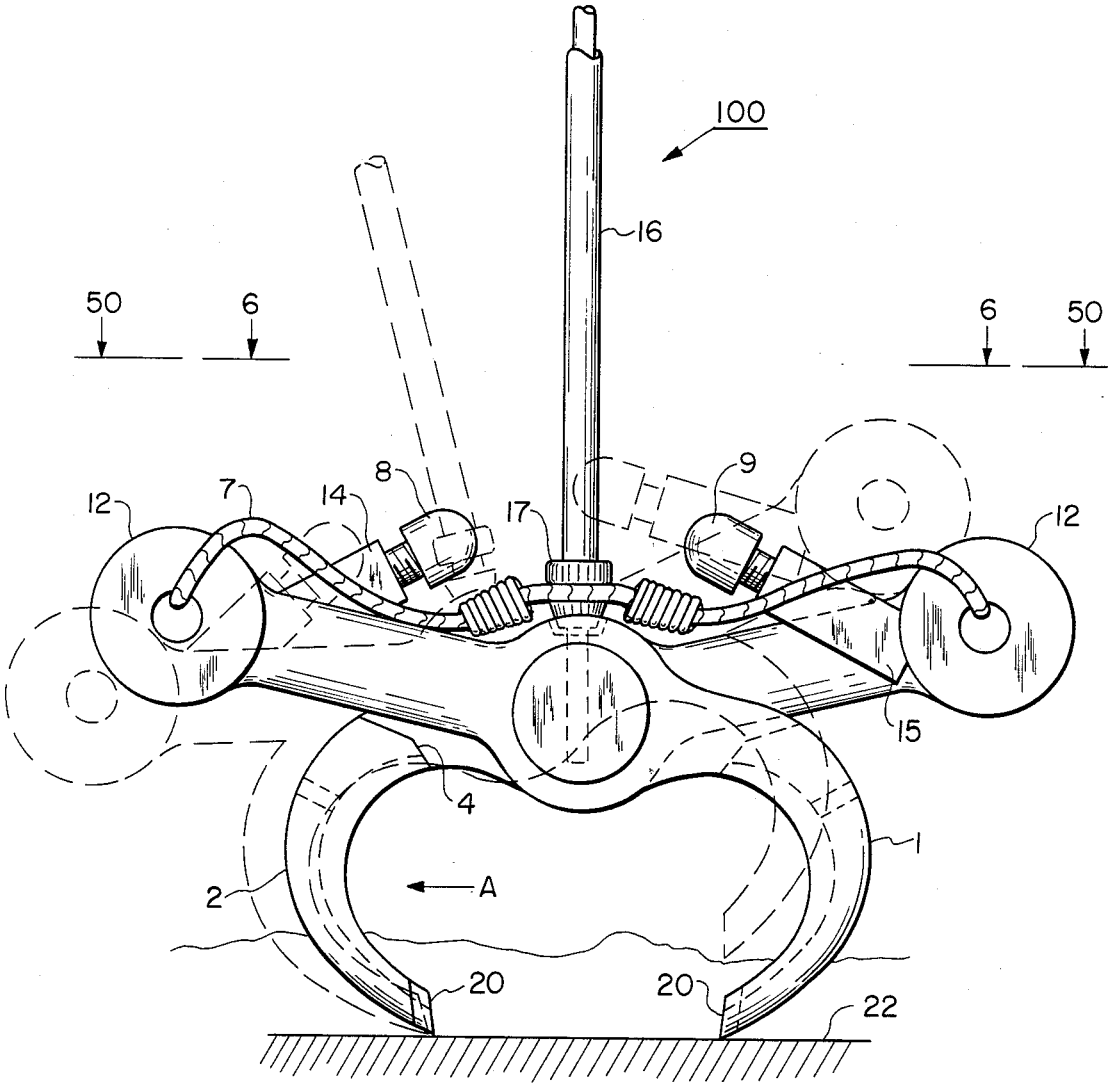
FIG. 4 is a front assembly view of the apparatus in its digging position, with its lower portions spread entirely apart. A vertical rod pressing on the apparatus' top-central portion causes the lower portions' ends to dig into the material.
Figure 5:
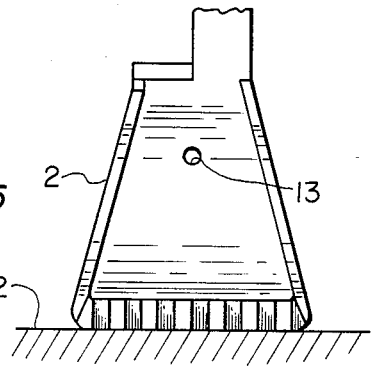
FIG. 5 is a partial inside view of one of the lower portions, indicated by the arrow A.

An embodiment of a shovel-like device is portrayed in the assembly drawings of FIGS. 1 to 8. Hoist cable 7 is shown attached centrally to vertical rod 16, as shown in FIGS. 1 and 4, as a possible arrangement. Actual fittings, rings or wire ropes used for attachments to the device would be decided by the user.

Apparatus in FIG. 1 shows its appearance when in suspension, by either someone holding and supporting rod 16 or by the arm of automatic machinery used in conjunction with the apparatus. The machinery would perform the task of a human operator in hazardous locations. Device 100 comprises two elongated members 1' and 2' with their approximate center pivoted with a pivot pin 10. To enable its lower portions to carry and haul away materials, its lower portions 1 and 2 are much wider than its upper portions. Ends 3 of lower portions 1 and 2 have teeth to enable the device to dig into loose dirt and other soft materials, which need to be carried away. Upper portions 1' and 2' have horizontal projections members 14 and 15 fastened firmly to upper portions, as shown. These projections have screw-in end knobs 8 and 9, shown in contact with rod 24, FIG. 1. They control the distance between teeth 20, FIG. 3, in lower portions 1 and 2. Screwing the screw-in knobs 8 and 9 would bring teeth 20 closer together. The tooth spacing would depend on the materials to be scooped up,—such as their particle sizes, viscosity and weight. Teeth 20 may be sharpened to more easily dig into material to be hauled. In order to help the device to dig into material, rod 16, its lower end placed inside recess 11, is pushed down into recess to cause sharpened tooth ends to dig into material; its outline only is shown. The shovelling of materials and the holding of vertical hollow rod 16 may be performed by a robot arm or by other remote means.

In FIG. 4, observe that when rod 16 is pushed downward into crevice 11, lower portions 1 and 2 separate out to the maximum extent, and teeth 20 become vertical, to facilitate digging into the material to be hauled. This is aided by weight means constituted by the weights 12 at the upper ends of member 1' and 2'. The material scooped up by device 100 is lifted by rod 16 and transported to another selected site for dumping. That location could be a dump truck. When the selected material is to be unloaded, after having been loaded, the device is lowered until it makes contact with the surface below. Upon making contact, lower portions 1 and 2 automatically separate from each other, as shown in FIG. 4. To unload material, rod 16 is tipped sideways, as shown in dashed lines, to enable lower portion 2 to pivot against member 21, thus raising lower portion 1, as shown. By portion 1 being raised, as shown in FIG. 4, material unloaded is permitted to remain on surface 22, when device 100 is lifted. Thus, lower portions 1 and 2 will not reload the unloaded material, when device 100 is lifted by means of rod 16, or rod 24.

Figure 6:
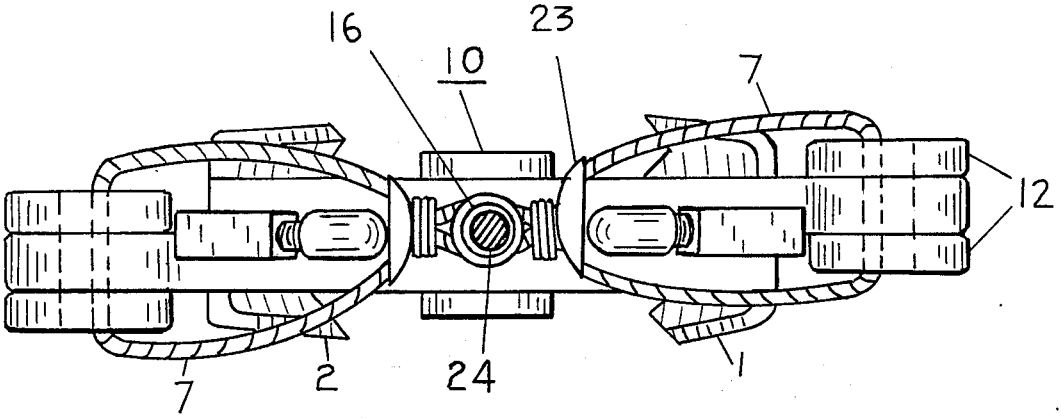
FIG. 6 is a top view of the front assembly with its lower portions separated, as shown in FIG. 4, and showing the hoist cable arrangement supporting the device, along line 6—6, FIG. 4.
Figure 7:
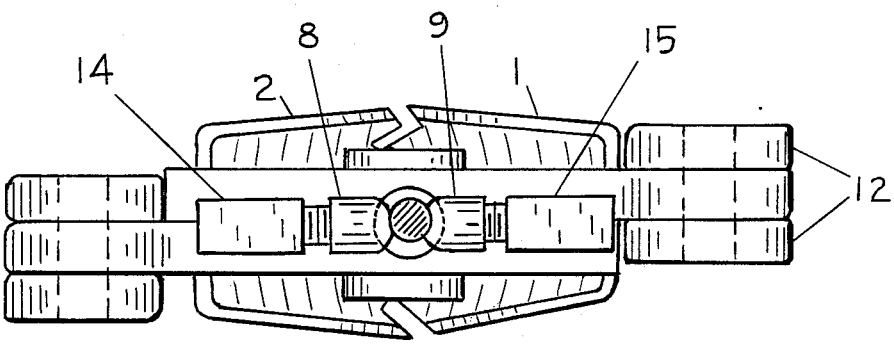
FIG. 7 is a top view of the front assembly shown in FIG. 1 with the device's lower portions together, along line 7—7, FIG. 1. Hoist cables are omitted.

Screw-in portions 8 and 9 wil not interfere with rod 16, as device 100 is lifted or lowered, because knobs 8 and 9 separate upon making contact with a surface to avoid any contact with rod 16. Hoist cable 7 straddles knobs 8 and 9 when device 100 is lowered onto a surface, as shown in FIG. 6. Clamps 23, FIG. 6, help cable loops 7 from interfering with screw-in portions 8 and 9. Hoist cables 7 are not shown in FIG. 7, so as not to obscure other portions of device 100.

Figure 8:
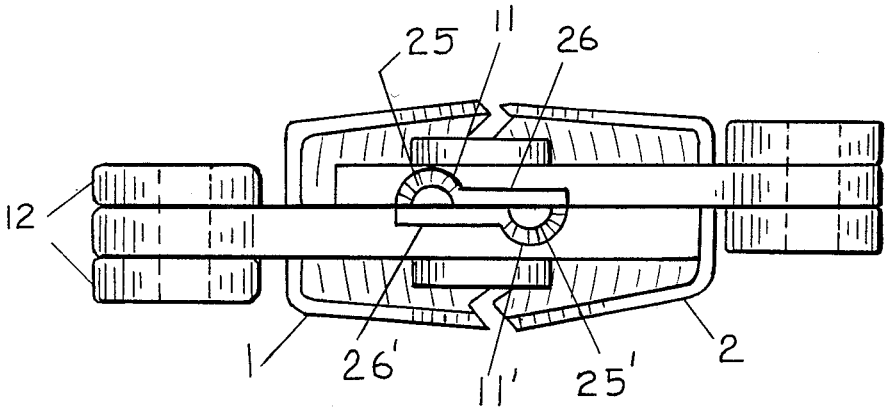
FIG. 8 is another top view of the assembly shown in FIG. 1, without both hoist cables and the upper horizontal support members. This view shows the slots and hole in the top-central portion of the device for the solid rod, shown in FIGS. 1 and 4.

A more desirable approach and design for rod-end 18 to ensure making immediate contact with recess 11, FIGS. 1 and 4, is to provide a solid rod or mast 24 as a rigid fixture attached to pin 10. End of rod 24 would be attached and fixed by screwing to the central portion of pivot pin 10, as shown in FIG. 1. Then rod 16 would be tubular, capable of sliding concentrically up and down rod 24. Thus, end 18 of rod 16 would be guided by rod or mast 24 to seat 11, consistently and without fail. Hub of rotating members at 11 would be slotted with slots 26 and 26', as shown in FIG. 8, to allow rod or mast 24 to remain fixed to the top-center of pin 10, while allowing upper portions 1' and 2' of device 100 to rotate about pin. Bottom end of rod 16 has annular recess 17', FIG. 28, for cable 7.

For materials, spring steel is suggested for rod 24 while high strength aluminum alloy is suggested for tubular member 16. High strength aluminum is suggested for the remainder of device 100 except for teeth at ends of lower portions 1 and 2, which teeth could be steel inserts. Pin 10 would be stainless steel.

For removing debris from lakes, lower portions of device 100 could be perforated, to allow the water the drain out while retaining the debris itself.

In FIGS. 1 and 4, threaded holes 13 in lower portion 1 and 2 are for screws with spiked or pointed ends to penetrate solid bulk material and to help hold such material in place. Such solid material may be short lengths of wood, corrugated boxes with cargo inside and garbage in plastic bags. The pointed screws would only be inserted in the lower portions of device if a possibility existed for the item lifted to fall out while suspended and damage would occur to the item itself and to something below.

Figure 10:
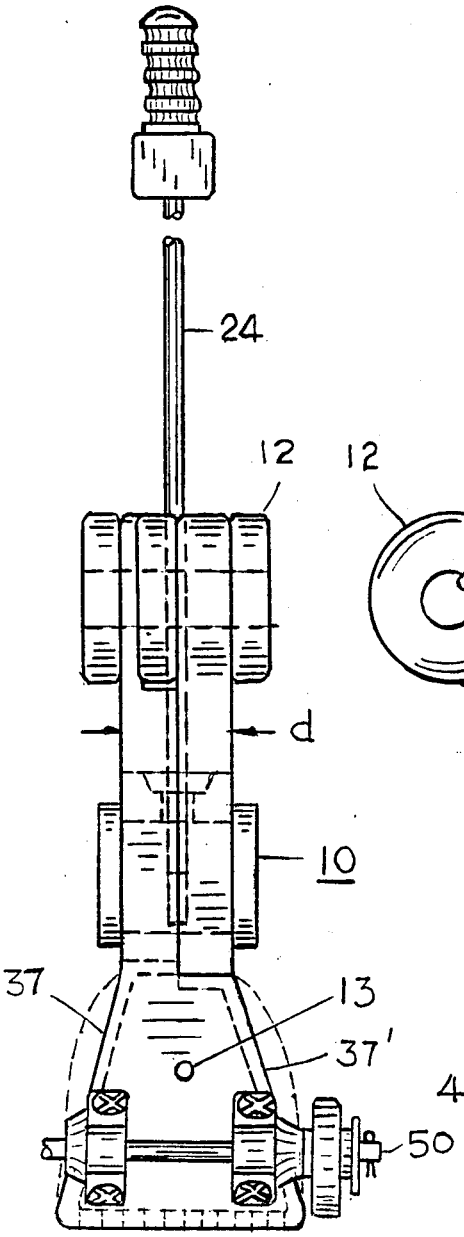
FIG. 10 shows a side view thereof.
Figure 9:
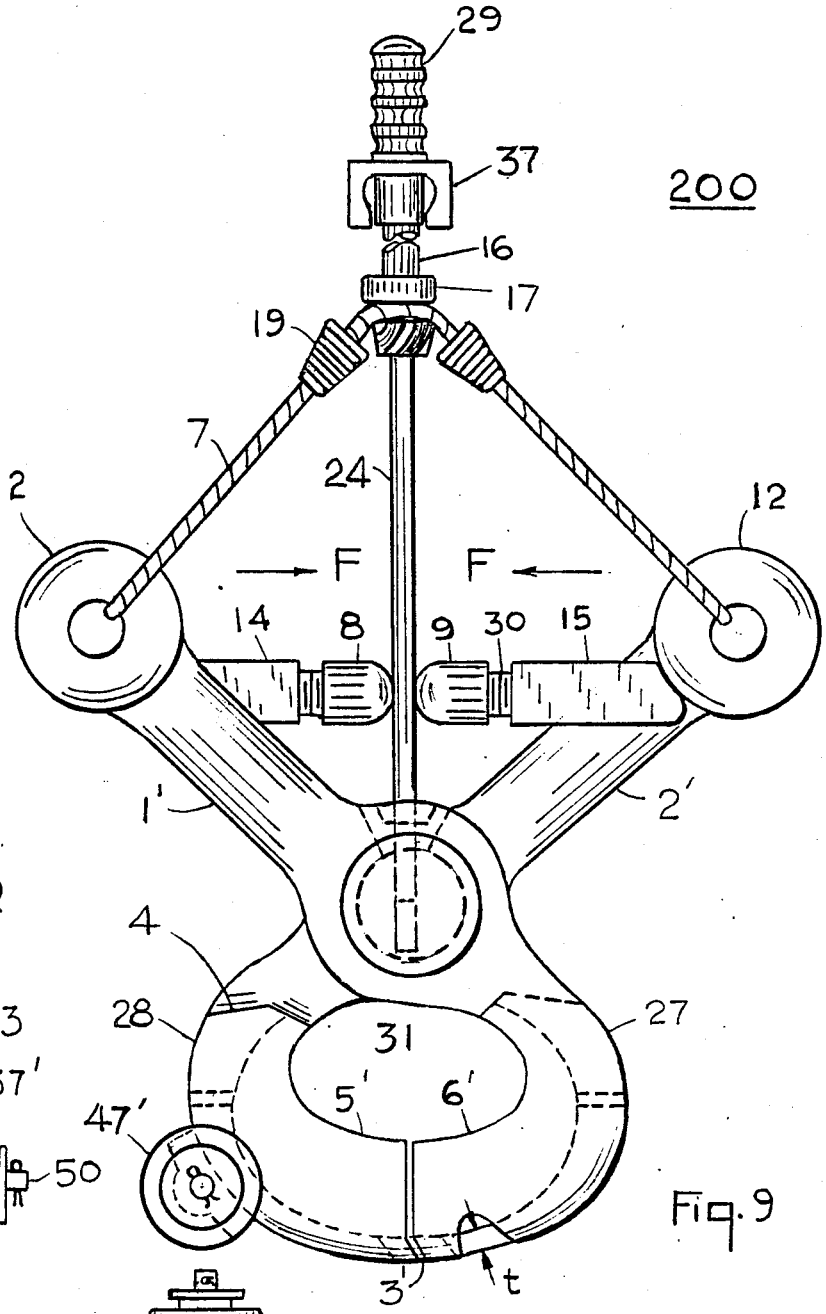
FIG. 9 shows a front view of the shovel-like, digging, scooping device in its suspended position, with a lower portion bucketshaped to accommodate a larger load of material without spillage.
Figure 11:
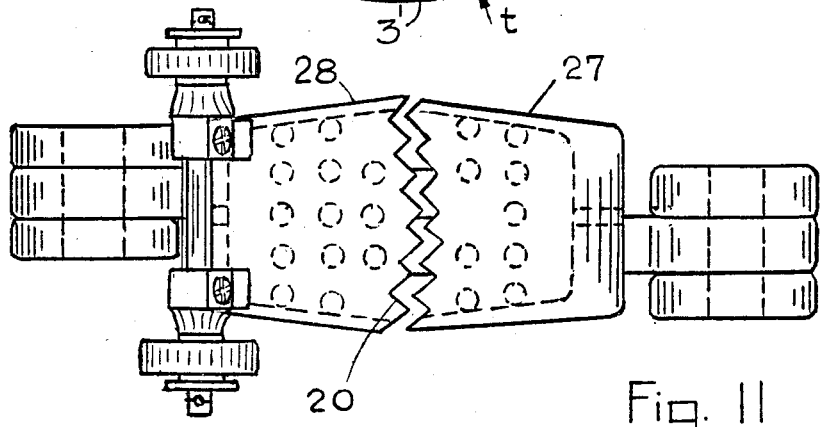
FIG. 11 shows a bottom view thereof.

For some applications, such as in the dredging of small lakes and rivers, it would be desirable to have lower portions 1 and 2 of apparatus bucket-shaped in order for it to carry a larger quantity of wet materials without spillage. For such applications, the device shown in FIGS. 9 to 11 has sides 37 and 37+, FIG. 10, which could be bulged outwardly as shown in dashed lines to scoop up an even larger quantity of material and retain such. Tops 5' and 6' of sides 37 and 37' are shown in FIG. 9 to show the device's capability to hold and retain more materials than the embodiment depicted in FIGS. 1 to 3. Lower portions 27 and 28, FIGS. 9 and 11, are shown slightly spread apart in their closed position, leaving small opening 31. Small space 31 may be eliminated by screwing in end portions 8 and 9. Field experimentation would determine whether in some conditions and for some materials an opening or space 31 would be desirable. If sticky materials are being loaded and unloaded, it would be possible for lower portions 27 and 18 to stick together, particularly at the teeth 20 location, preventing upper portions 1' and 2' from separating to unload its contents. Slight spacing 31 may prevent such an occurence.

Except for its lower portions, device 200 is the same as device 100, FIG. 1. Horizontal projections 14 and 15 with knobs 8 and 9 may be unnecessary for loading materials which are not sticky and heavy. Knobs 8 and 9, when present, would share some of the stress exerted on teeth 20 when in contact. Knobs 8 and 9 may be removed, leaving members 14 and 15, when not needed to share the stresses exerted on teeth 20, in order to help reduce the device's overall weight. Also knobs when abutting rod 24 are capable of controlling the spacing between ends of lower portions, in order to avoid teeth 20 from sticking to each other.

Either high strength aluminum or high strength composition plastics is suggested for either device 100 or 200, with the exceptions of rod or mast 24, pin 10, teeth 20, which could be stainless steel inserts,—in order to keep the weights of the devices 100 and 200 down.

A user would hold handle 29, FIG. 9, to carry, apply downward force and to lift either devices 100 or 200. Enlarged portion 18, FIGS. 1 and 9, is designed to fit into recess 11 when downward force is applied on device, as shown in FIGS. 4 and 6.

Figure 12:
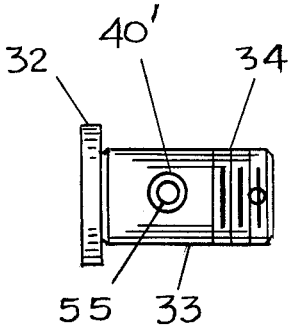
FIG. 12 is a side detailed view of the pivot pin without the nut.
Figure 13:
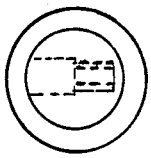
FIG. 13 is an end view thereof.
Figure 14:
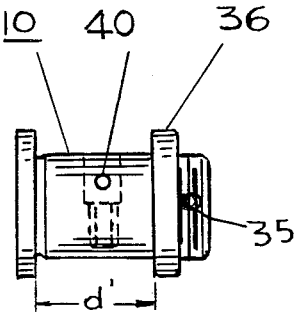
FIG. 14 is a side view of the pivot pin's assembly.
Figure 15:
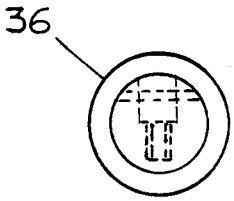
FIG. 15 is an end view thereof.
Figure 16:
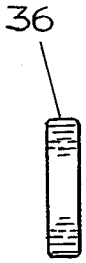
FIG. 16 is a side view of the nut itself.
Figure 17:
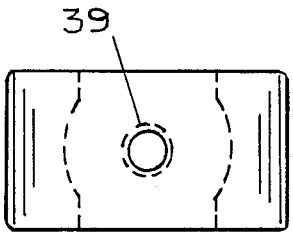
FIG. 17 is a top view of the horseshoe magnet to enable positive load retension.
Figure 30:
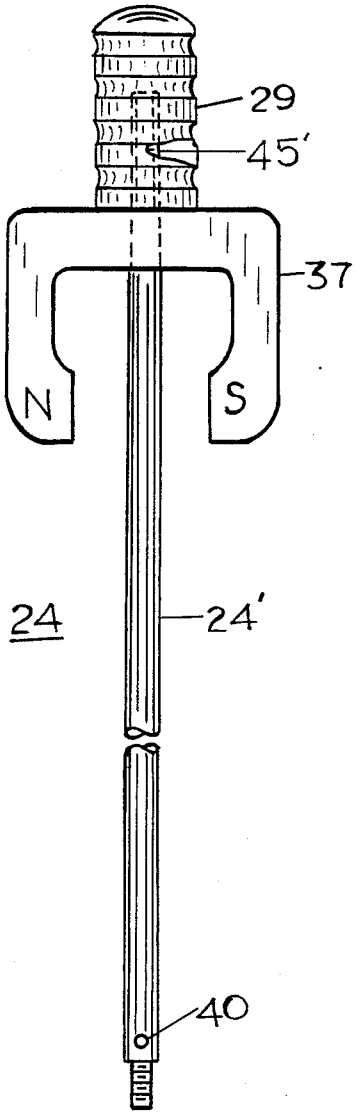
FIG. 30 is an assembly elevational view of the solid rod whose bottom end is fixed to the pivot pin of FIG. 14.
Figure 31:
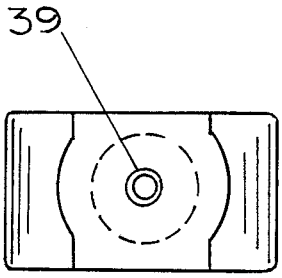
FIG. 31 is an end view thereof.

Details of pivot pin 10 are shown in FIGS. 12 to 16. FIG. 12 is a side view of pin 33 itself without nut 36 showing threaded portion 34. Concentric holes 40' is provided for end of rod 24, FIG. 30 and FIG. 13 is its end view. FIG. 14 is a side view assembly with nut 36 in place. Tapered hole 40 is provided for tapered pin, not shown, to keep rod 24 from unscrewing out of concentric holes 40', the smaller hole 55 being threaded. FIG. 15 is its end view. FIG. 16 is a side view of nut 36. A cotter pin may be placed in hole to keep nut 36 in place, or a retaining ring may be inserted in a groove in its stead. Distance d', FIG. 14, would be approximately equal to distance d, FIG. 10. There should be sufficient clearance provided by distance d' to allow free movement of portions 1' and 2' of either device 100 or 200. Antifreeze, super penetrant oil could be used, in addition to a hard bronze bushing, not shown, to prevent any binding between pivot pin 10 and either device 100 or 200.

Sides 37 and 37', device 100 or 200, may bulge outwardly, as shown in dashed lines, in order to enable either device to hold and transport more material. The thickness of the walls of lower portions 1 and 2, FIGS. 1, and 27 and 28, FIG. 9, would remain the same.

Without the presence of horizontal projections 14 and 15, cable spread brackets 23, FIG. 6, would be unnecessary. Brackets 23 were provided to prevent any interference between cable 7 and screw-in members 8 and 9, when devices 100 and 200 are in the digging and loading position with lower portions 1 and 2 or 27 and 28 separated.

POSITIVE LOAD RETENSION

Figure 18:
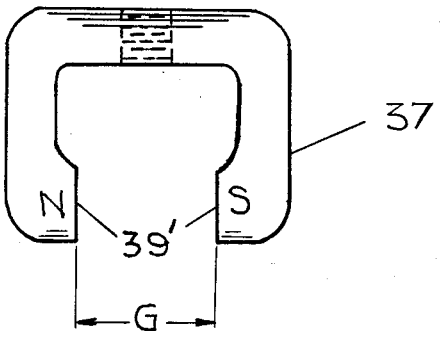
FIG. 18 is a front view of the permanent horseshoe magnet.
Figure 19:
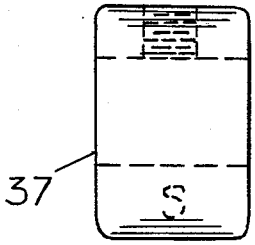
FIG. 19 is a side view thereof.
Figure 20:
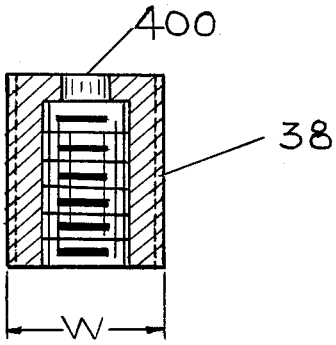
FIG. 20 is a sectional view of a soft steel core for the magnet in FIG. 17 along line 20—20 of FIG. 21.
Figure 21:
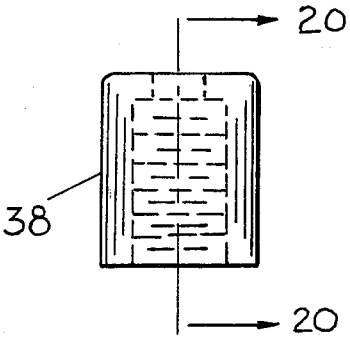
FIG. 21 is a side view of the soft steel core.

In case of the possibility that in lifting a load and then tilting the apparatus that tubular shaft 16 may move downward tending to cause the separation of lower portions 5 and 6, positive load retension is acquired by means of a horseshoe magnet 37, FIG. 9. Pole faces 39 inside of magnet 37, adhere to soft steel prism 38, having a cylindrical hole underneath for insertion of tubular shaft rod or member 16. Both handle 29 and magnet 37 are fastened to rod 24. Shaft rod or member 16 slides up to close portions 5' and 6' and slides down to open and separate portions 5' and 6', as shown in FIG. 4. Also bottom of portions 5' and 6' may be perforated, as shown in dashed circular lines, FIG. 11, to allow water and liquid in loaded debris to drain out, if so desired. FIGS. 18 and 19 show details of the horseshoe magnet, while FIGS. 20 and 21 show details of soft steel core, attached to tubular shaft 16. It should be noted that Gap G, FIG. 18, is slightly wider than width W of soft steel core, FIG. 20, to allow a slight clearance between the two, as they move relative to each other in the apparatus' operation.

For some applications, lengths of rods 16 and 24 may be increased. Examples are when used in removing debris from bottoms of lakes, in removing materials from deep dug-outs and in removing materials at ground level from a first or second floor height.

Figure 22:
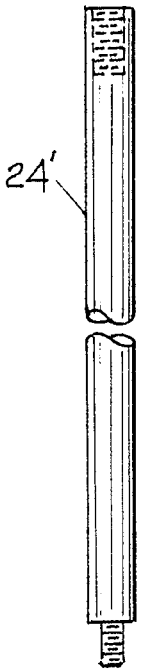
FIG. 22 is a side elevational view of a solid rod with threaded ends, for an extension to the rod of FIG. 30.
Figure 24:
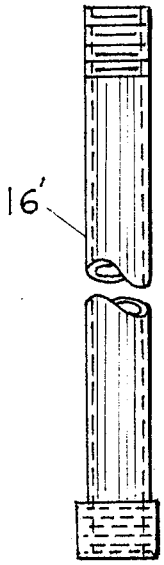
FIG. 24 is a side elevational view of a tubular rod, also threaded at both ends, for use as an extension to the rod of FIG. 28.
Figure 23:
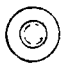
FIG. 23 is an end view thereof.
Figure 25:
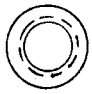
FIG. 25 is an end view thereof.
Figure 26:
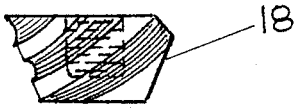
FIG. 26 is a side elevational view of a helical-grooved lower support member for tubular rod of FIG. 24, enlarged bottom end.
Figure 27:
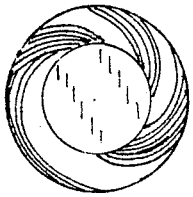
FIG. 27 is a bottom end view thereof.
Figure 29:
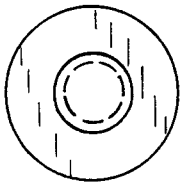
FIG. 29 is an end view thereof.

To extend or lengthen inner rod 24, additional rods 24' may be screwed onto the bottom of existing rod 24. Similarly, additional tubes 16' may be added to existing tubular rod 16 by screwing to its top tubes 16', in order to correspondingly increase its length, as shown in FIGS. 22 to 25. FIG. 22 shows a side view of extension rod 24', and FIG. 23 is its end view. FIG. 24 shows a side view of extension tubular rod 16', and FIG. 25 is its end view. One end of each rod 16' and 24', has a male thread, and its other end has a female thread.

Rods 16 and 24 would have threads to accommodate the threads of extensions 16' and 24'.

For dirty environments and when loading quantities of soil, bottom portion 18 of rod 16, FIG. 9, could have helical grooves 18'like the grooves of a hollow drill, to enable it to remove any debris accumulating in recess 11, in order to allow it to seat properly in recess 11. Debris in recess 11 would be removed by rotating rod 24 in a clockwise direction, the debris being brought up to the surface of device portions 1' and 2' by grooves 8' of portion 18, FIGS. 27 and 28. User could hold onto grooved plastic sleeve or grip 16'', FIG. 28, to rotate rod 16.

Figure 28:
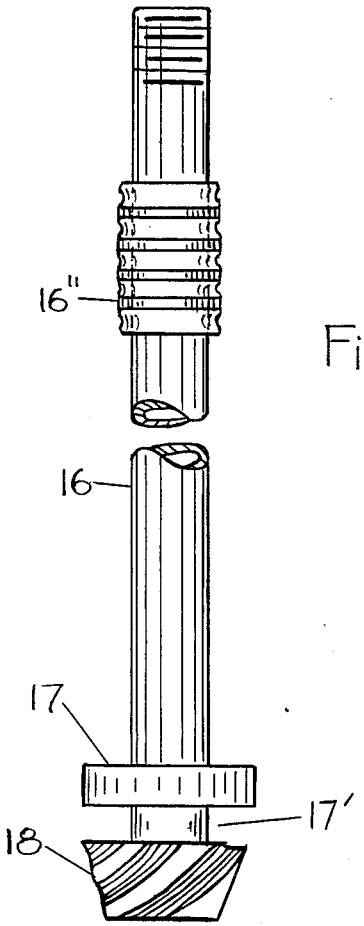
FIG. 28 is an assembly elevational view of the vertical sliding tubular rod, without the steel core of FIG. 21.

To illustrate the sliding portion 16 of device 200, front elevation view, FIG. 28, is provided, showing the grooved bottom portion 18 and retaining sleeve 17 for cable 7, shown in FIG. 6. Both members 17 and 18 constrain and retain center portion of cable 7 in position, with the aid of twine, shown in FIGS. 1 and 9. It should be noted that tubular member 16 is hollow to allow steel rod 24, FIG. 30, to pass through, as shown in elevational assembly of device 200, FIG. 9. Upper portion of rod 16 has an external thread for screwing on of soft steel hollow prism 38, FIG. 21. To enable the user to increase the lengths of both rod 24 assembly and member 16, when required, extension members 24' and 16' are shown in FIGS. 23 and 25, both members allowing rod 24 and member 16 to be increased identical amounts.

Rod assembly 24 has a cylindrically-shaped plastic handle 29 with grooves for enabling the user to have a firm grip of the handle of the apparatus. Handle 29 would have a central threaded hole 45 to accommodate the threaded upper portion 45' of rod 24, FIGS. 34 and 35 provide detailed information of handle 29.

It should be noted that pole faces 39 of magnet, FIG. 18, have concave-curved shapes to be used in conjunction with cylindrically-shaped member 38, FIG. 21. The purpose for curved pole faces 39 is to provide a smaller uniform air gap between magnet 37 and steel core 38 for effective magnetic attraction between the horseshoe magnet and prism 38.

Figure 34:
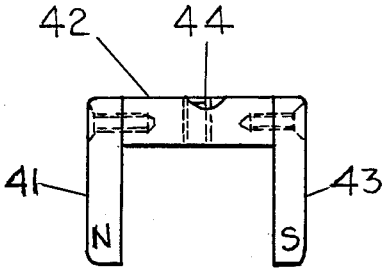
FIG. 34 is an elevational view of the handle itself of FIG. 30.
Figure 35:
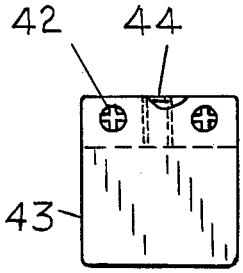
FIG. 35 is a bottom end view thereof.

FIGS. 34 and 35 show views of an alternate design for the horseshoe magnet, its front view being FIG. 34 and its side view being FIG. 35. If the proper size horseshoe magnet is unavailable, then this alternate design could be considered. The assembly comprises rectangular prisms designated as 41, 42 and 43. Prism 42 is composed of soft steel, while 41 and 43 are shown as north and south poles, respectively, facing each other. The three pieces are held together by four screws, as shown. Alnico magnets are suggested for magnets 41 and 43. Center piece 42, FIG. 35, has a threaded central hole 44, for screwing onto stainless steel rod 24.

Figure 32:
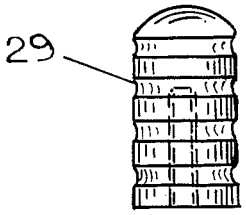
FIG. 32 is a front view assembly of an alternate design for the horseshoe magnet, wherein the magnet is fabricated of three pieces.
Figure 33:
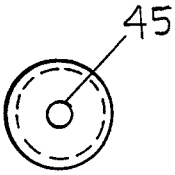
FIG. 33 is a side view thereof

FIGS. 32 and 33 show two views of a handle or knob 29 attached to threaded end of rod 24. FIG. 32 is an elevational view of the grooved plastic handle, while FIG. 33 is its end view. For this design, magnets 41 and 43 may need to have greater magnetic strength to perform the same positive retension function as horseshoe magnet 37.

It should be mentioned here that the drawings herein described are not necessarily drawn to scale, particularly rods 16 and 24. For heavy loads and for longer length rods, both rods may need to be thicker and larger in diameter, than shown.

In regard to materials used for fabrication, the two elongated halves 1' and 2' comprising the apparatus FIGS. 1 and 9, may be composed of high impact plastic for light weight and for reduced cost. The dies for injection molding would be expensive, so that a large market potential would need to be assured to justify the expense. Aluminum alloy sand casting would be considerably less expensive for small quantity production. Thicknesses of both its lower and upper portions 1', 2', 27 and 28, FIG. 9, may be reduced by adding ribs for increasing stiffness while reducing weight of devices 100 and 200.

For moving heavy loads of 20 lbs. or more over short distances, wheels 47 and 48 may be added to lower portion 28, FIG. 9. The wheels are supported by axle 50. To move loads on wheels 47 and 48, rod 24 is tipped backward as shown in dashed lines, FIG. 4, then pushed ahead on wheels, but with the device's lower portions in contact with each other. Positive load retension is assured because of magnet 37 being attracted to soft steel prism 38, FIG. 9.

Figure 36:
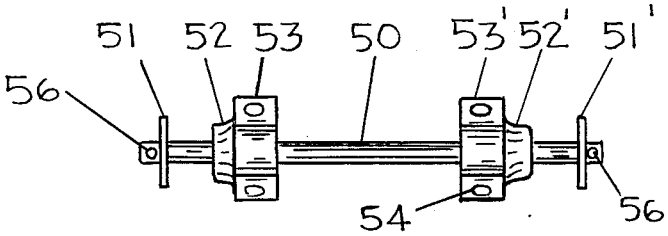
FIG. 36 is a front view of the axle assembly but without the wheels.
Figure 37:
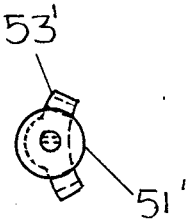
FIG. 37 is an end view thereof.

An assembly view of the wheels' axle assembly is shown in FIGS. 36 and 37, FIGS. 36 and 37, without wheels 47 and 48. FIG. 36 is its front and FIG. 37 is its end view. The axle 50 is supported by identical bearing blocks 53 and 53' having holes for axle 50 to pass through with ease. Bearing blocks 54 and 54' may be screwed into the under side of lower portion 28, FIG. 9, where shown. For the order of assembly, axle 50 is passed through holes in blocks 53 and 53'. Prepared grooves in axle 50 could mark the locations for the above blocks. A spring type sleeve with a slotted opening could allow axle 50 to be snapped into place without the need for the bearing blocks 53 and 53'. After the blocks 53 and 53' are fastened to lower portion 28 with screws into prepared threaded holes, then wheels 47 and 48 are mounted, as shown in FIG. 9. Following their mounting washers 51 and 51' are inserted over ends of axle 50; then cotter pins, not shown, are inserted into holes 56 for retaining wheels 47 and 48 in place. After insertion of cotter pins, ends of pins are spread apart. The above order of assembly may be altered to suit the fabricator of the apparatus. For example, the wheels could be mounted prior to fastening axle assembly to lower portion 28. When not needed, the entire assembly may be removed by unscrewing screws 54. The screws could be captured bolts, to avoid the possibility of their loss when removed from appartus. The wheels 47 and 48 could be made of high inpact plastic for reduced weight over metal wheels. Bearing blocks 53 and 53' have protrusions 52 and 52' respectively.

Figure 38:
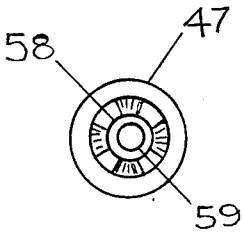
FIG. 38 is a front view of one of the two spoked wheels.
Figure 39:
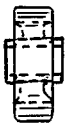
FIG. 39 is a side view thereof.

To avoid removing the entire assembly, as mentioned above, when not needing the wheels, either only wheels 47 and 48 need be removed or axle 50 may be removed including the wheels, leaving blocks 53 and 53' in place. Hub 58 of wheel 47 with hole 59, is shown in FIG. 38. FIG. 39 is its side view.

This apparatus or device could be supported on a single wheel by extending the single wheel outward, away from a lower portion's 28 underside surface 28', FIG. 9, using an appropriate bracket with axle bearing blocks, similar to blocks 53 and 53'. Thus, the single wheel could be free to rotate about an axle; the axle itself need not rotate.

In FIG. 36, length L is not drawn to scale. Consequently, length L' would not be drawn to scale, to conform to the scale of either device 100 and 200. Lengths L and L' would depend on whatever width D, device 200, is selected to be. Length of axle 50 has been shortened when transferred to FIG. 10, device 200.

In order to avoid any misunderstanding concerning the details of the two pieces comprising the structural construction of the apparatus shown in FIG. 1, FIGS. 40 to 45 are provided.

FIGS. 40 to 47 show details of the two pivoted pieces, while FIGS. 46 to 49 show details of the two horizontal projections fastened to each of the two upper portions of the pieces. The details of slots 26 and 26' in upper portions of hubs of the two pieces, FIGS. 40 and 43, are shown more clearly in these figures than in assembly drawing, FIG. 1. Slots 26 and 26' are required to allow sideways or lateral movement of rod 24. Conical recess 11 and 11' in upper portions of hubs allows helical grooved bottom end 18 of tubular rod 16 to be seated when rod 16 is pushed down, at which time lower portions 1 and 2, FIG. 1, are spread apart.

Horizontal projections 14 and 15 are optional and enable bottom lower portions 1 and 2 to completely close or to remain partially apart, as shown in FIGS. 1 and 9. Notice that the ends of 5' and 6', FIG. 9, are slightly apart, because screw-in portions 8 and 9 have been unscrewed slightly and moved outward. If screwed inward, ends of portions 5' and 6' would come together and make contact. Ends of screw-in portions 8 and 9 may be concave-shaped to make better contact with rod 24. In addition, portions 8 and 9 could share the stress on ends of portions 5' and 6' when the two ends are allowed to make contact, FIGS. 1 and 9, by having screwin porions 8 and 9 make contact with rod 24 simultaneously. If not cast as a single piece with elongated pieces, horizontal projections 14 and 15 could be welded or screwed to upper portions 1' and 2', respectively. If screwed, they could be removed when not needed, reducing the weight of the apparatus.

Details of horizontal projections 14 and 15 are shown in FIGS. 46 to 49; FIGS. 46 and 48 being their front views, and FIGS. 47 and 49 being their top views. Note that outer ends of horizontal projections 14 and 15 have threaded holes 60 and 61, respectively, for screw-in portions 8 and 9, respectively. As mentioned before, these projections could be screwed onto elongated pieces shown in FIGS. 40 and 43, in which case screw holes would need to be added.

Figure 50:
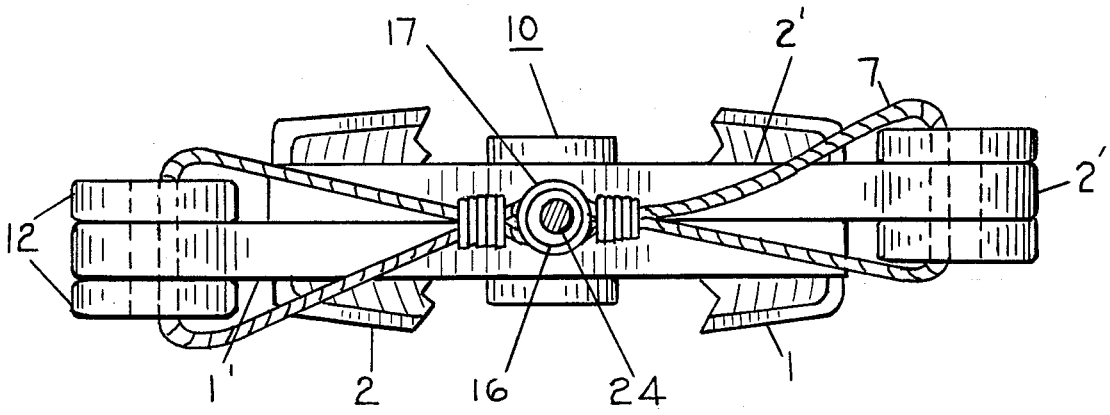
FIG. 50 is a top view of the front assembly, FIG. 1, along line 50—50, FIG. 4, with its lower portions separated, but witout its upper horizontal projections. These projections really are unnecessary for the operation of the device.

In the above descriptions and drawings of the apparatus, horizontal projections 14 and 15 have been either included or implied in its design. To be more explicit, FIGS. 1, 4 and 9 show horizontal projections 14 and 15 and screw-in portions 8 and 9. It should be explained that these projections are a refinement and not essential for any of the operations or functions for which the device is intended. Consequently, FIG. 50, a top view along line 50—50, FIG. 4, has been added to show how the device's top view would look without the projections. Note that cable bracket 23 is unnecessary when the projections are omitted.

What is claimed is:

1. A hand-held or robot-arm-held shovel-like device for digging, loading and discharging a load of material that is solid, loose, wet, dry and/or combinations of such material, this shovel-like device comprising:

(a) a tongs-like assembly which inoludes substantially like-pivoted members arranged as mirror images thereof, the lower end of each member formed with and as an arcuate configuration and with a pivotal connecting means formed intermediate the length extent of each member and with the upper extent of each member having securement means thereon:

(b) a pivot pin providing said pivotal connecting means and disposed so as to retain the pivoted members in a swingable array with the arcuate ends, adapted to move towards and away from each other;

(c) a rod-like member having a larger, first outer handle end adapted for grasping and the other inner end adapted for securing to said pivotal means;

(d) an elongated tubular slide which is sized to be movable along said rod like member, and with said first outer handle end sufficiently larger than the tubular slide so as to provide a stop limit for the outward movement of said tubular slide along said rod-like member, and with the other limit of movement of this tubular slide provided by the pivoted members at the pivot pin means connection;

(e) a flexible cable-like member having one end secured to the outer end opposite the formed arcuate end of the pivoted members and with the other end secured to the tubular slide, and (f) weight means provided with each pivoted member so that when said tubular slide is moved toward the pivot means, said flexible cable-like member is relaxed and the weight of each pivoted member is sufficient to cause the tongs-like arcuate ends to be opened so as to enter and engage said material, and when said tubular slide is lifted, said cable-like member is brought into a taut condition causing said arcuate ends of the pivoted members to move towards each other entrapping said material so that this entrapped material may be moved by said shovel-like device.

2. A device in accordance with claim 1, and wherein said arcuate ends of said lower portions have sharp teeth, said ends with said teeth mating with each other, to enable said ends to both dig and load said material without losing any of said material when under suspension.

3. A device in accordance with claim 1, and wherein each of said lower portions has sides in order for said device to entrap and hold more material when said tubular slide is lifted.

4. A device in accordance with claim 1, wherein said lower portions have perforations, allowing excess water and other liquids in said wet material to drain through said perforations.

5. A device in accordance with claim 1, wherein said rod-like member further includes securing to said member, a horseshoe magnet with a gap facing downward, mounted on top of said rod-like member and fastened thereto, and said shorter tubular slide having a soft steel core with a central hole, mounted on top, whereby when said tubular slide with said core is lifted and pushed into and between said gap, magnetic lines of force of said magnet hold said core in place within said gap, thus achieving positive load retention for said material loaded onto said lower portions, even though said device be tipped into a horizontal position.

6. A device in accordance with claim 1, and wherein said lower end portions have underside surfaces and wherein one of said lower portions has one or more wheels on an axle, said axle mounted on one of said underside surfaces, so that said wheels are free to rotate about said axle, whereby said device can be suported on said wheels for transporting said material from one site to another, said wheels to enable one to haul a greater weight of material than one could conveniently haul without said wheels.

7. A device in accordance with claim 1, and wherein said tubular slide has an enlarged bottom end and is loosely attached to a midway point of the end securement, said flexible cable-like member being cables, said bottom end having a recessed annular area to retain said cables, and said cables being tied around said annular area, thus preventing said cables from becoming unattached to said bottom end, but allowing rotation of said tubular slide.

8. A device in accordance with claim 1, wherein each of said upper portions of the pivoted members has an inside surface, and wherein these upper portions each have a selectively fastened horizontal projection, each projection having a screw-in knob at one end, and wherein one said projection is attached to one said inside surface with said knob extending inward and the other said projection being attached to the other said inside surface with said knob also extending inward; each said knob in an abutting position with the rod-like member controlling the spacing between said ends when said device is lifted by the handle of said rod-like member, said spacing being greater when lifting nmaterials tending to cause said ends to stick to each other.

9. A handheld or robot-arm-held shovel-like device for digging, loading and unloading solid, loose or wet material with automatic features, comprising a tongs-like part having two elongated members and having upper and lower portions, pivoted approximately midway with a pivot pin, each of said upper portions having a hole, for use with a cable being loosely connected between each said hole when said lower portions are in contact with a surface, said lower portions being sharply curved toward each other and having ends that are forced into contact with each other as a result of the tension on said cable produced by said device's weight distribution to scoop up and carry said material for transportation to a selected site, whereby said lower portions will separate automatically when the tension in said cable is significantly reduced, thus enabling said material to be discharged; and wherein said pivot pin has a hub, said hub having an aperture, a vertical rod member extending through said aperture, said rod member being rigidly fixed to said pivot pin; a tubular slide, having a bottom end and means for securing said cable at its midway point to said bottom end, sliding over said rod member, said member being a guide for the vertical up and down movement of said tubular slide, so that said bottom end of said slide can seek said aperture for applying downward force on said device for digging into said material; and when said tubular slide is lifted with said cable, said ends of said lower portions coming together, entrapping said material.

10. A device in accordance with claim 9, and wherein said aperture are apertures, and wherein said apertures comprise a conical recess and slots extending downward to said pivot pin, said recess accommodating said bottom end of said tubular slide, and said slots allowing rotation of said lower portions about said rod member, and said rod member, with said pivot pin fixed thereto, being held vertically.

* * * * *